US007518029B2

(12) United States Patent
Sekhar et al.

(10) Patent No.: US 7,518,029 B2
(45) Date of Patent: Apr. 14, 2009

(54) PROCESS FOR DESTRUCTION OF GELLED SULPHUR MUSTARD

(75) Inventors: Krishnamurthy Sekhar, Gwalior (IN); Ramesh Chandra Malhotra, Gwalior (IN); Balwant Singh Batra, Gwalior (IN); Kumaran Ganesan, Gwalior (IN)

(73) Assignee: Defence Research & Development Organisation, New Delhi (IN)

( * ) Notice: Subject to any disclaimer, the term of this patent is extended or adjusted under 35 U.S.C. 154(b) by 218 days.

(21) Appl. No.: 10/545,827

(22) PCT Filed: Sep. 18, 2003

(86) PCT No.: PCT/IN03/00315

§ 371 (c)(1),
(2), (4) Date: May 9, 2006

(87) PCT Pub. No.: WO2004/073800

PCT Pub. Date: Sep. 2, 2004

(65) Prior Publication Data

US 2006/0235259 A1 Oct. 19, 2006

(30) Foreign Application Priority Data

Feb. 18, 2003 (IN) ..... 137/DEL/2003

(51) Int. Cl.
*A62D 3/00* (2007.01)

(52) U.S. Cl. ..... 588/321

(58) Field of Classification Search ..... None
See application file for complete search history.

(56) References Cited

U.S. PATENT DOCUMENTS 6,479,723 B1 * 11/2002 Malhotra et al. ..... 588/316
6,852,903 B1 * 2/2005 Brown et al. ..... 588/299
2003/0050525 A1 * 3/2003 Ishiyama et al. ..... 588/203

FOREIGN PATENT DOCUMENTS

WO 0054846 A1 9/2000
WO WO 00/54856 A1 9/2000

OTHER PUBLICATIONS

Yang, Yu-Chu, Baker, James A., Ward, J. Richard. Decontamination of Chemical Warfare Agents. Chem Rev. 1992, 92, 1992, 92, 1729-1743.*

Shaw, Robert W. and Santesson, Johan. "New Technologies for Destruction of Chemical Weapons." Organization for the Prohibition of Chemical Weapons. 1994. Proceedings 5th Annual Symposium Protection Against Chemical and Biological Warfare Agents. Stockholm: 1995. 140, 135-144.*

Kroschwitz, Jacqueline I., Howe-Grant, Mary. "Nitrogen." Encyclopedia of Chemical Technology 4th ed. 1996.*

Recommendations for the Disposal of Chemical Agents and Munitions [online]. National Academy Press, Washington, D.C. 1994. Retrieved from the internet: <URL:www,books,nap.edu/books/0309050464/gifmid/113.gif>. P. 113, lines 10-21; p. 160-162; p. 168, lines 11-27; p. 169, lines 15-23.

Chemiewawffenvemichtung in der Praxis: Eine komplexe Herausforderung [online]. Geen Cross Schweiz Apr. 1, 2002. Retrieved from th internet: <URL: www.greencross.ch/pdf/2002_04_de.pdf>. P. 6, left column, last paragraph—middle column 1 paragraph; p. 7, diagram.

* cited by examiner

*Primary Examiner*—Melvin Curtis Mayes
*Assistant Examiner*—Sheng Han
(74) *Attorney, Agent, or Firm*—The Webb Law Firm

(57) ABSTRACT

A process for the complete destruction of gelled sulphur mustard (SM), comprising the steps of: (a) dissolving gelled sulphur mustard (SM) in organic solvent such as 2-chloroethanol, methanol, methyl cellosolve or mixtures of these to obtain a clear mixture, (b) incinerating the clear gelled sulphur mustard solvent mixture obtained from step (a); (c) dissolving residual gelled SM obtained from step (c) into non-toxic products; (d) chemically converting dissolved SM obtained from step (c) into non-toxic products.

11 Claims, No Drawings

PROCESS FOR DESTRUCTION OF GELLED SULPHUR MUSTARD

FIELD OF INVENTION

This invention relates to a process for the destruction of gelled or semi-solid sulphur mustard referred to as 'Heel', which does not drain off from the bulk vessels/munitions during destruction of sulphur mustard.

PRIOR ART

Sulphur mustard (SM), chemically known as 1,1'-thiobis-(2-chloroethane) is highly toxic and persistent liquid vesicant. SM on storage in the bulk containers and munitions become partly "gelled" or crusty. The extent of gelling or solidification depends on the process used for manufacture of SM, storage conditions and duration for which SM resided in the containers.

Processes known in the art for destruction of pure SM consist of high temperature reaction technology, which involve destruction of SM by heating at high temperature. The technologies are incineration, pyrolysis, plasma torch and molten metal systems. Among all these high temperature reaction technologies, incineration is a well-proven technology for the destruction of pure SM and is widely used for the destruction of pure SM.

The main disadvantage of incineration is that it cannot be used for 'gelled', SM (heel) due to the difficulty in draining off the gelled SM from storage containers.

Another known process in the art for destruction of pure SM is the low temperature destruction technology based on hydrolysis of SM.

The main disadvantage of the technology involving hydrolysis is that gelled SM is insoluble in water and alkaline solution and hence cannot be used for the destruction of gelled SM.

Another known process in the art for destruction of pure SM is the low temperature destruction technology based on electrochemical oxidation. In this process SM is oxidized in Ag(II)/AG(I) electrochemical cell in acidic medium.

The main drawback of this technology based on electrochemical oxidation is that sulphone of SM is one of the products of oxidation of pure SM, which is toxic in nature.

Another drawback of this technology based on electrochemical oxidation is that the nature of oxidation products of gelled SM is not known because the chemical composition of gelled SM is uncertain.

Yet another drawback of this technology based on electrochemical oxidation is that it cannot be used for bulk destruction of pure SM.

Still another drawback of this technology based on electrochemical oxidation is that the cost involved is very high.

Another known process in the art for destruction of pure SM is the low temperature destruction technology based on solvated electron system in which pure SM is reduced by solution of metallic sodium in anhydrous liquid ammonia.

The main disadvantage of the above low temperature destruction process based on solvated electron system is that gelled SM cannot be transferred from storage container to the reaction vessel. Thus this technology cannot be applied for the destruction of gelled SM.

Another disadvantage of the above destruction process based on solvated electron system is that it requires precise conditions for the use of highly reactive metallic sodium.

Since hydrogen chloride is present in the gelled SM, it may lead to uncontrollable exothermic (highly flammable) reaction.

Another known process in the art of destruction of pure SM is the low temperature destruction technology based on chemical conversion using thiophilic agents.

The major drawback of the destruction process based on thiophilic agents is that this method is suitable only for pure SM. Since the chemical composition of the gelled SM is uncertain, it cannot be used for the destruction of gelled SM.

Need for the Present Invention

There is a need to develop either separate technology for the destruction of gelled SM (Heel) or to find out suitable organic solvent in which gelled SM is highly soluble and the resultant solvent-gelled SM mixture can be incinerated easily using incineration technology.

Objects of the Present Invention

The main object of the present invention is to provide a process for the destruction of gelled sulphur mustard (SM)/Heel.

Another object of the present invention is to provide a process for the destruction of gelled SM, which is eco-friendly.

Yet another object of the present invention is to provide a process for the destruction of gelled SM, which does not require specialized plant/equipment for the bulk destruction.

Still another object of the present invention is to provide a process for the destruction of gelled SM, which is cost effective.

Yet another object of the present invention is to provide a process for the destruction of gelled SM, which meets the verification requirement of the Organisation for the Prohibition of Chemical Weapons (OPCW).

Yet further object of the present invention: is to provide a process which completely destroys gelled SM.

Description of Process

According to this invention there is provided a process for the complete destruction of gelled sulphur mustard (SM), comprising the steps of:

(a) Dissolving gelled sulphur mustard (SM) in organic solvent such as 2-chloroethanol, methanol, methyl cellosolve or mixture of these; preferably 2-chloroethanol.

(b) Incinerating the clear gelled sulphur mustard-solvent mixture obtained from step (a);

(c) Dissolving remaining gelled SM obtained from step (b);

(d) Chemically converting dissolved SM obtained from step (c) into non-toxic products.

The exact chemical composition of the gelled SM varies depending on production method used, preservative added, storage period/conditions. However, it is generally assumed to be polymeric cyclic and polysulphonium salts in varying percentages. There are also indications that in addition to these polymeric compounds, dithiane, 1,2-dichloroethane, sulphone and sulphoxides of SM and sesquimustard are also present. If moisture is present in the SM during production, it hydrolyses pure SM slowly and hydrogen chloride (HCl) is generated. By the addition of preservatives like picoline, most of the HCl generated will be consumed by picoline to form picoline hydrochloride, while remaining free HCL on long standing, reacts with container toform gaseous hydrogen and iron salts.

The present process for the destruction of gelled Sulphur Mustard (SM) comprises of the following steps:

(a) Dissolution of Gelled SM in Organic Solvents:

Solvents like 2-Chloroethanol or methanol or methyl cellosolve or mixture of these solvents is added to gelled SM in the ratio 2:1 to 1:5 w/w preferably in the ratio 1:1. After addition of the solvent, it is left for 10 to 90 days, preferably 30 days at 20° C. to 50° C. temperature, preferably at 30° C. To dissolve the gelled SM completely, nitrogen gas is then bubbled through the mixture for 5 to 30 hours, preferably 10 hrs at the rate of 1 to 10 Liter per minute (LPM), preferably 5 LPM.

(b) Incineration of Solvent-Gelled SM Mixture:

The clear liquid from step (a) is incinerated at 800-1500° C. preferably at 1200° C. A residence time of 1-6 seconds, preferably 3 seconds, in the high-temperature area is sufficient to achieve complete destruction of gelled SM-solvent mixture. Sulphur dioxide and HCI, generated by combustion, is neutralized by passing through a 5-20% solution of sodium hydroxide, preferably 10% solution. This process produces sodium sulphate and sodium chloride, both of which are non-toxic.

(c) Dissolution of Remaining Gelled SM:

Gelled SM to the extent of about 10%, which is not soluble in the above solvents remains, after the removal of clear-gelled SM-solvent mixture for incineration. Methyl cellosolve is added to the remaining gelled SM in the ratio 2:1 to 1:3, preferably in the ratio 1:1 and left for 2-3 hrs at temperature 25-40° C., preferably at 30° C. Nitrogen gas is bubbled through it for 1-10 hrs, preferably 5 hrs at the rate of 1 to 10 Liter per minute (LPM), preferably 5 LPM to dissolve the residue completely in methyl cellosolve.

(d) Chemical Conversion of Dissolved SM:

To the mixture of methyl cellosolve and SM obtained in step (c), powdered sodium hydroxide (in the ratio sodium hydroxide: methyl cellosolve, 1:10 to 1:20 w/w, preferably 1:14 w/w) is added and nitrogen gas is again bubbled at the rate of 1 to 10 Liter per minute (LPM), preferably 5 LPM, for 1-10 hrs preferably 5 hrs. Then diethylenetriamine (DETA, equivalent to 1-5 times w/w, preferably 2.5 times, w/w of methyl cellosolve) is added and the content is left for 5-15 days, preferably seven days. After this period of 15 days the mixture is free from SM completely and there is no gelled SM left in the container.

The present invention will now be illustrated with working examples, which are intended to be illustrative examples and are not intended to be taken restrictively to imply any limitation on the scope of the present invention.

WORKING EXAMPLE 1

One ton of 2-chloroethanol (2-CE) was added to one ton of gelled SM and left for 15 days at 30° C. Then, nitrogen gas was bubbled through it for 8 hrs at the rate of 3 LPM to dissolve the gelled SM completely. The clear liquid was then incinerated at 800° C., for 6 seconds. The remaining about 10% of gelled SM (100 kg), which was not soluble in 2-CE remained as residue. To this, methyl cellosolve 150 kg was added and left for 2 hrs at 30° C. Nitrogen gas was bubbled for 1 hr to dissolve the residue completely in the methyl cellosolve, To this, methyl cellosolve 150 kg was added and left for 2 hrs at 30° C. Nitrogen gas was bubbled for 1 hr to dissolve the residue completely in the methyl cellosolve. To this, 10.5 kg of powdered sodium hydroxide is added and nitrogen was bubbled again for 2 hrs, then DETA (375 kg) was added and the mixture was left for one week for the destruction of SM.

WORKING EXAMPLE 2

One ton of 2-chloroethanol (2-CE) was added to one ton of gelled SM and left for 30 days at 30° C. Then, nitrogen gas was bubbled through it for 10 hrs at the rate of 5 LPM to dissolve the gelled SM completely. The clear liquid was then incinerated at 1200° C., for 3 seconds. The remaining about 10% of gelled SM (100 kg), which was not soluble in 2-CE remained as residue. To this, methyl cellosolve 150 kg was added and left for 2 hrs at 30° C. Nitrogen gas was bubbled for 1 hr to dissolve the residue completely in the methyl cellosolve. To this, 10.5 kg of powdered sodium hydroxide was added and nitrogen was bubbled again for 2 hrs, then DETA (375 kg) was added and the mixture was left for one week for the destruction of SM.

WORKING EXAMPLE 3

1.5 ton of 2-chloroethanol (2-CE) was added to one ton of gelled SM and left for 20 days at 30° C. Then, nitrogen gas was bubbled through it for 25 hrs at the rate of 2 LPM to dissolve the gelled SM completely. The clear liquid was then incinerated at 1000° C., for 4 seconds. The remaining about 10% of gelled SM (100 kg), which was not soluble in 2-CE remains as residue. To this, methyl cellosolve 150 kg was added and left for 2 hrs at 30° C. Nitrogen gas was bubbled for 1 hr to dissolve the residue completely in the methyl cellosolve. To this, 10.5 kg of powdered sodium hydroxide was added and nitrogen was bubbled again for 2 hrs, then DETA (375 kg) was added and the mixture was left for one week for the destruction of SM.

It is to be understood that the present invention is susceptible to modifications, changes and adaptations are intended to be within the scope of the present invention which is further set forth under the following claims.

We claim:

1. A process for the complete destruction of gelled sulphur mustard (SM), comprising the steps of:

(a) dissolving gelled sulphur mustard (SM) in organic solvent selected from the group consisting of 2-chloroethanol, methanol, methyl cellosolve, and mixtures and combinations thereof to obtain a clear mixture, (b) transferring and destroying the clear mixture of dissolved gelled SM solution and organic solvent obtained from step (a) using an incinerator;

(c) dissolving residual gelled SM obtained from step (b) by adding methyl cellosolve; and (d) chemically converting the dissolved SM obtained from step (c) into non-toxic products by adding powdered sodium hydroxide and then diethylenetriamine.

2. The process of claim 1 wherein the ratio of gelled SM to organic solvent in step (a) is 2:1 to 1:5 w/w.

3. The process of claim 1 wherein the clear mixture of gelled SM and organic solvent produced by step (a) is maintained at a temperature of 20° C. to 50° C. temperature, and for a period of 10 to 90 days.

4. The process of claim 1 wherein in step (a) gelled SM is dissolved in organic solvent in the presence of nitrogen gas bubbled through the mixture for 5 to 30 hours and at a rate of 1 to 10 liter per minute (LPM).

5. The process of claim 1 wherein clear liquid obtained from step (a) is incinerated in step (b) at 800-1500° C. for a period of 1-6 seconds.

6. The process of claim 1 wherein in step (c) the remaining gelled SM is dissolved by adding methyl cellosolve in the ratio of 2:1 to 1:3 w/w.

7. The process of claim 1 wherein in step (c) the gelled SM is dissolved in methyl cellosolve by bubbling nitrogen gas for a period of 1-10 hrs and at a rate of 1 to 10 liter per minute.

8. The process of claim 1 wherein step (d) comprises in-adding powdered sodium hydroxide to methyl cellosolve-gelled SM mixture obtained in step (c) in the ratio of 1:10 to 1:20 w/w.

9. A The process of claim 8 wherein the methyl cellosolve-gelled SM mixture obtained in step (c) is dissolved by bubbling nitrogen for a period of 1-10 hours at a rate of 1 to 10 liter per minute.

10. The process of claim 9 wherein diethylenetriamine is added to methyl cellosolve-gelled SM mixture obtained in step (c), equivalent to 2 to 4 times of methyl cellosolve used.

11. The process of claim 10 wherein the methyl cellosolve-gelled SM mixture is kept for 5-10 days at a temperature of 20° C. to 50° C.

* * * * *

UNITED STATES PATENT AND TRADEMARK OFFICE

CERTIFICATE OF CORRECTION

PATENT NO. : 7,518,029 B2
APPLICATION NO. : 10/545827
DATED : April 14, 2009
INVENTOR(S) : Sekhar et al.

It is certified that error appears in the above-identified patent and that said Letters Patent is hereby corrected as shown below:

Title page, Column 2, OTHER PUBLICATIONS, the last reference, line 2, "Geen Cross" should read -- Green Cross --

Column 5, Lines 10-11, Claim 8, "comprises in-adding" should read -- comprises adding --

Signed and Sealed this

Twenty-fifth Day of August, 2009

David J. Kappos

David J. Kappos
*Director of the United States Patent and Trademark Office*